US009167362B2

(12) United States Patent
Koskowich

(10) Patent No.: US 9,167,362 B2
(45) Date of Patent: Oct. 20, 2015

(54) IMPLANTABLE RECEPTACLE FOR A HEARING AID COMPONENT

(75) Inventor: Gregory N. Koskowich, Pleasanton, CA (US)

(73) Assignee: OtoKinetics Inc., Cincinnati, OH (US)

( * ) Notice: Subject to any disclaimer, the term of this patent is extended or adjusted under 35 U.S.C. 154(b) by 0 days.

(21) Appl. No.: 13/615,378

(22) Filed: Sep. 13, 2012

(65) Prior Publication Data

US 2014/0073840 A1 Mar. 13, 2014

(51) Int. Cl.
*H04R 25/00* (2006.01)

(52) U.S. Cl.
CPC ..... *H04R 25/606* (2013.01)

(58) Field of Classification Search
CPC ..... H04R 25/606; H04R 2225/67
USPC ..... 181/135; 381/322, 217, 270; 600/25; 607/57; 623/10
See application file for complete search history.

(56) References Cited

U.S. PATENT DOCUMENTS

| | | | |
|---|---|---|---|
| 2,521,414 | A | 9/1950 | Schier |
| 4,071,029 | A | 1/1978 | Richmond et al. |
| 4,880,707 | A | 11/1989 | Kohno et al. |
| 5,273,379 | A | 12/1993 | Nishimura |
| 5,411,467 | A | 5/1995 | Hortmann et al. |
| 5,478,093 | A | 12/1995 | Eibl et al. |
| 5,531,787 | A | 7/1996 | Lesinski et al. |
| 5,772,575 | A | 6/1998 | Lesinski et al. |
| 5,796,188 | A | 8/1998 | Bays |
| 5,951,601 | A | 9/1999 | Lesinski et al. |
| 5,977,689 | A | 11/1999 | Neukermans |
| 5,984,859 | A | 11/1999 | Lesinski |
| 6,068,589 | A | 5/2000 | Neukermans |
| 6,120,484 | A | 9/2000 | Silverstein |
| 6,153,966 | A | 11/2000 | Neukermans |
| 6,361,526 | B1 | 3/2002 | Reisdorf et al. |

(Continued)

FOREIGN PATENT DOCUMENTS

| | | |
|---|---|---|
| DE | 39 81 086 C1 | 9/1990 |
| DE | 296 21 987 U1 | 4/1997 |

(Continued)

OTHER PUBLICATIONS

International Search Report and Written Opinion in International Application No. PCT/US2013/040454, mailed Nov. 26, 2013.

(Continued)

*Primary Examiner* — Christine H Matthews
*Assistant Examiner* — Joshua D Lannu
(74) *Attorney, Agent, or Firm* — Nixon Peabody LLP

(57) ABSTRACT

An implantable receptacle for receiving a hearing aid component includes a body having a proximal portion, a distal cylindrical portion and a joining portion joining the proximal portion to the distal cylindrical portion. First flexible tines extending from an outer wall of the distal cylindrical portion in the general direction of the proximal portion are configured to engage with and lock the distal cylindrical portion to a wall of a fenestration in a bone of the patient in a permanent fashion in response to pressing the sleeve into the fenestration. Second flexible tines extending from an outer wall of the distal cylindrical portion in a direction generally tangential to the circumference of the distal cylindrical portion are configured to engage with and prevent rotation of the distal cylindrical portion within the wall of the fenestration.

6 Claims, 5 Drawing Sheets

(56) References Cited

U.S. PATENT DOCUMENTS

| | | | | |
|---|---|---|---|---|
| 6,561,231 | B2 | 5/2003 | Neukermans | |
| 6,606,389 | B1 | 8/2003 | Selfridge et al. | |
| 6,689,302 | B2 | 2/2004 | Reisdorf et al. | |
| 7,846,095 | B2 | 12/2010 | Christopherson et al. | |
| 7,955,250 | B2 | 6/2011 | Jaeger et al. | |
| 8,192,488 | B2 | 6/2012 | Lesinski et al. | |
| 2002/0062875 | A1 | 5/2002 | Neukermans | |
| 2002/0076075 | A1 | 6/2002 | Muller et al. | |
| 2003/0055311 | A1 | 3/2003 | Neukermans et al. | |
| 2005/0171579 | A1 | 8/2005 | Tasche et al. | |
| 2005/0203557 | A1 | 9/2005 | Lesinski | |
| 2006/0161255 | A1 | 7/2006 | Zarowski et al. | |
| 2007/0260254 | A1 | 11/2007 | Lesinski | |
| 2008/0167516 | A1 | 7/2008 | Jaeger et al. | |
| 2008/0215148 | A1* | 9/2008 | Lesinski et al. | 623/10 |
| 2013/0303835 | A1 | 11/2013 | Koskowich | |

FOREIGN PATENT DOCUMENTS

| | | | |
|---|---|---|---|
| WO | 96/23443 | A1 | 8/1996 |
| WO | 01/50813 | A2 | 7/2001 |
| WO | 03/037212 | A3 | 5/2003 |
| WO | 2006/102555 | A2 | 9/2006 |
| WO | 2006/102555 | A3 | 9/2006 |
| WO | 2012/163397 | A1 | 12/2012 |

OTHER PUBLICATIONS

International Search Report and Written Opinion in International Application No. PCT/US2013/059554, mailed Feb. 14, 2014.
International Search Report in International Application No. PCT/US2006/010673, mailed Sep. 12, 2006.
Office Action for U.S. Appl. No. 11/886,134, mailed Sep. 28, 2011.
Notice of Allowance for U.S. Appl. No. 11/886,134, mailed Mar. 5, 2012.
Office Action for U.S. Appl. No. 13/468,983, mailed Jan. 3, 2014.
Office Action for U.S. Appl. No. 13/468,983, mailed Apr. 10, 2014.
Office Action for U.S. Appl. No. 13/468,983, mailed Dec. 4, 2014.
Extended European Search Report in European Application No. 13788033.2, dated Mar. 31, 2015.
Office Action for U.S. Appl. No. 13/468,983, mailed Jul. 13, 2015.
Extended European Search Report in European Application No. 13837062.2, dated Jul. 31, 2015.

* cited by examiner

IMPLANTABLE RECEPTACLE FOR A HEARING AID COMPONENT

RELATED APPLICATIONS

This patent application may be considered related to (1) U.S. patent application Ser. No. 11/886134, filed Sep. 11, 2007 entitled "Implantable Therapeutic Appliance for the Cochlea" in the name of inventors George S. Lesinski, Armand P. Neukermans, Richard Grant and Kevyn Irving, now U.S. Pat. No. 8,192,488 issued Jun. 5, 2012; and (2) U.S. patent application Ser. No. 13/468983, filed May 10, 2012 entitled "Microactuator" in the name of Gregory N. Koskowich.

TECHNICAL FIELD

The present disclosure relates generally to an anchor or sleeve for implantation into a bone of a subject such as a human patient. The sleeve receives a component of an implantable hearing aid system such as a microactuator for transducing sound signals.

BACKGROUND

Active components of an implantable hearing aid system, such as a microactuator for transducing sound signals to convey the impression of sound to the subject receiving the implant, need to be mounted in a way that they can be retrieved and replaced, repaired or upgraded should the need arise.

OVERVIEW

An implantable receptacle for receiving a hearing aid component includes a body having a proximal portion, a distal cylindrical portion and a joining portion joining the proximal portion to the distal cylindrical portion. First flexible tines extending from an outer wall of the distal cylindrical portion in the general direction of the proximal portion are configured to engage with and lock the distal cylindrical portion to a wall of a fenestration in a bone of the patient in a permanent fashion in response to pressing the sleeve into the fenestration. Second flexible tines extending from an outer wall of the distal cylindrical portion in a direction generally tangential to the circumference of the distal cylindrical portion are configured to engage with and prevent rotation of the distal cylindrical portion within the wall of the fenestration.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of a microactuator for use with a fully implantable hearing aid. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
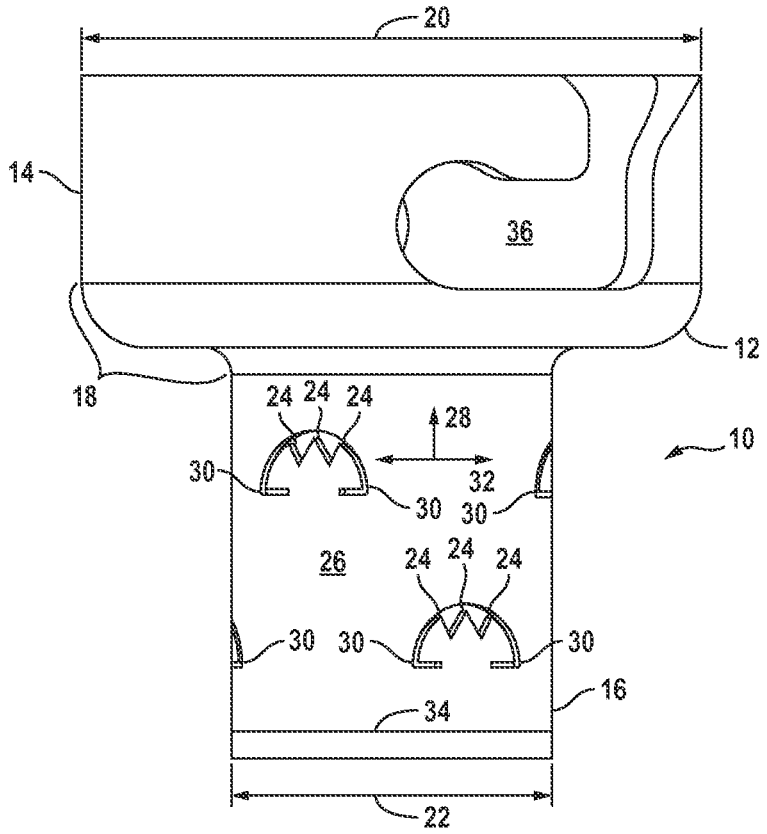
FIG. 1 is an elevational drawing showing an implantable receptacle for a hearing aid component in accordance with a first embodiment.

FIG. 1 is an elevational drawing showing an implantable receptacle 10 for a hearing aid component in accordance with a first embodiment. Receptacle 10 includes a body 12 having a proximal portion 14, a distal cylindrical portion 16 and a joining portion 18 joining the proximal portion 14 to the distal cylindrical portion 16.

Proximal portion 14 has a first cross-sectional maximum axial diameter 20 and distal cylindrical portion 16 has a second, smaller, maximum cross-sectional axial diameter 22.

A first plurality of flexible first tines 24 are formed in wall 26 of distal cylindrical portion 16, e.g., by laser cutting and then deforming the tines slightly outwardly, e.g., so that they protrude from the surface of wall 24 by approximately one thickness of the wall material. The first plurality of first tines 24 extend in the general direction 28 of the proximal portion and are configured to engage with and lock distal cylindrical portion 16 to a wall of a fenestration in a bone of a patient in a permanent fashion in response to pressing the sleeve into the fenestration.

A second plurality of flexible second tines 30 are formed in wall 26 of distal cylindrical portion 16, e.g., as described above for the first tines 24. The second plurality of second tines 30 extend in a direction 32 generally tangential to the circumference 34 of distal cylindrical portion 16 and are configured to engage with the wall of the fenestration and prevent rotation of the distal cylindrical portion 16 within the wall of the fenestration.

In one embodiment proximal portion 14 is cylindrical and includes at least one bayonet-type locking sleeve 36 configured to engage with at least one corresponding pin (not shown) extending from the hearing aid component and removably lock the hearing aid component to the receptacle.

In one embodiment the receptacle 10 is formed partially or completely of medical grade titanium for long term implantation into a human subject.

Figure 2:
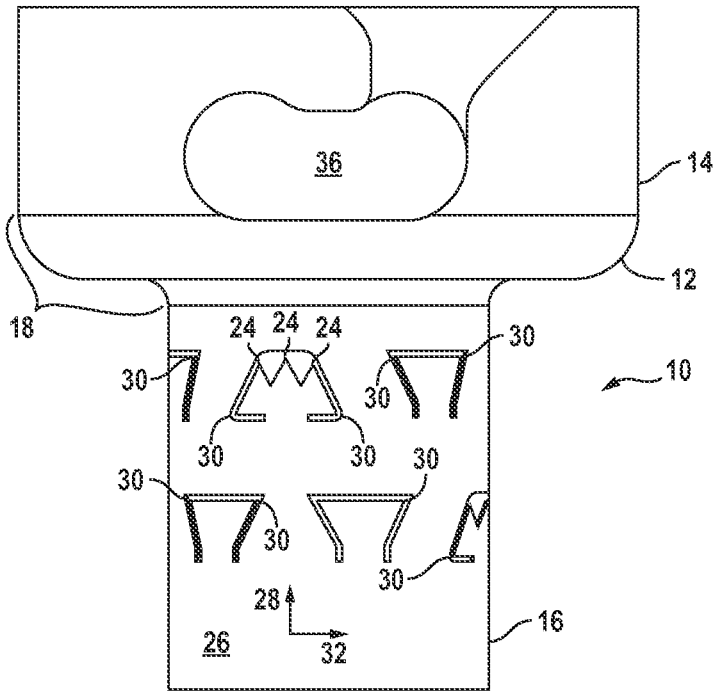
FIG. 2 is an elevational drawing showing an implantable receptacle for a hearing aid component in accordance with a second embodiment.
Figure 3:
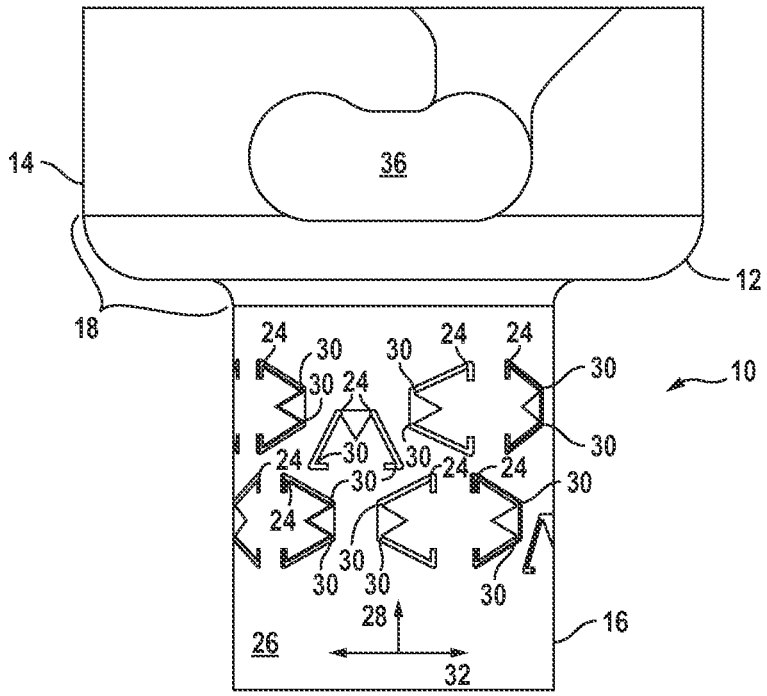
FIG. 3 is an elevational drawing showing an implantable receptacle for a hearing aid component in accordance with a third embodiment.
Figure 4:
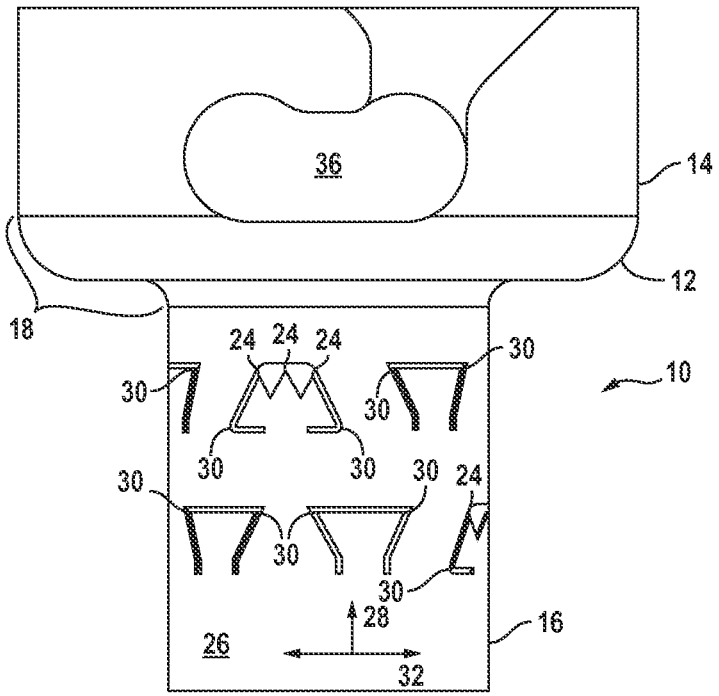
FIG. 4 is an elevational drawing showing an implantable receptacle for a hearing aid component in accordance with a fourth embodiment.
Figure 5:
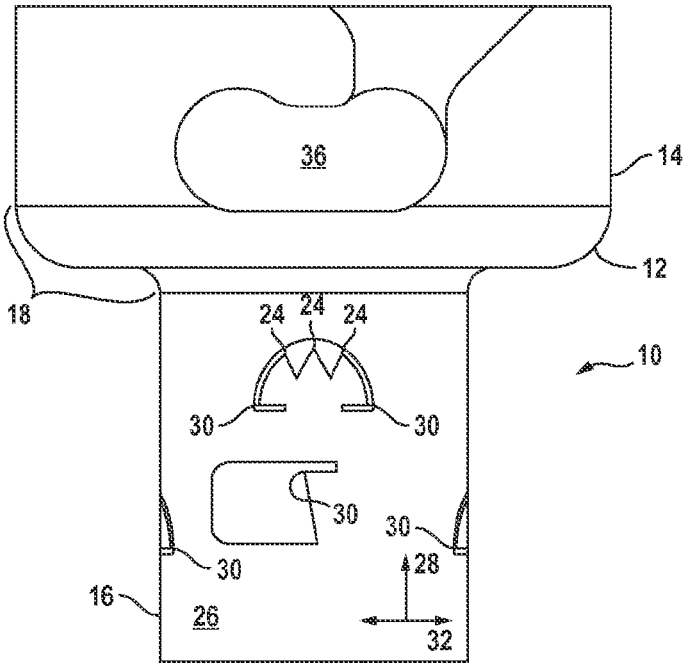
FIG. 5 is an elevational drawing showing an implantable receptacle for a hearing aid component in accordance with a fifth embodiment.

Other configurations of tines are also contemplated. For example, FIG. 2 is an elevational drawing showing an implantable receptacle for a hearing aid component in accordance with a second embodiment; FIG. 3 is an elevational drawing showing an implantable receptacle for a hearing aid component in accordance with a third embodiment; FIG. 4 is an elevational drawing showing an implantable receptacle for a hearing aid component in accordance with a fourth embodiment; and FIG. 5 is an elevational drawing showing an implantable receptacle for a hearing aid component in accordance with a fifth embodiment. In each arrangement tines are provided extending along directions 28 and 32 to assist in permanently securing the receptacle 10.

Figure 6:
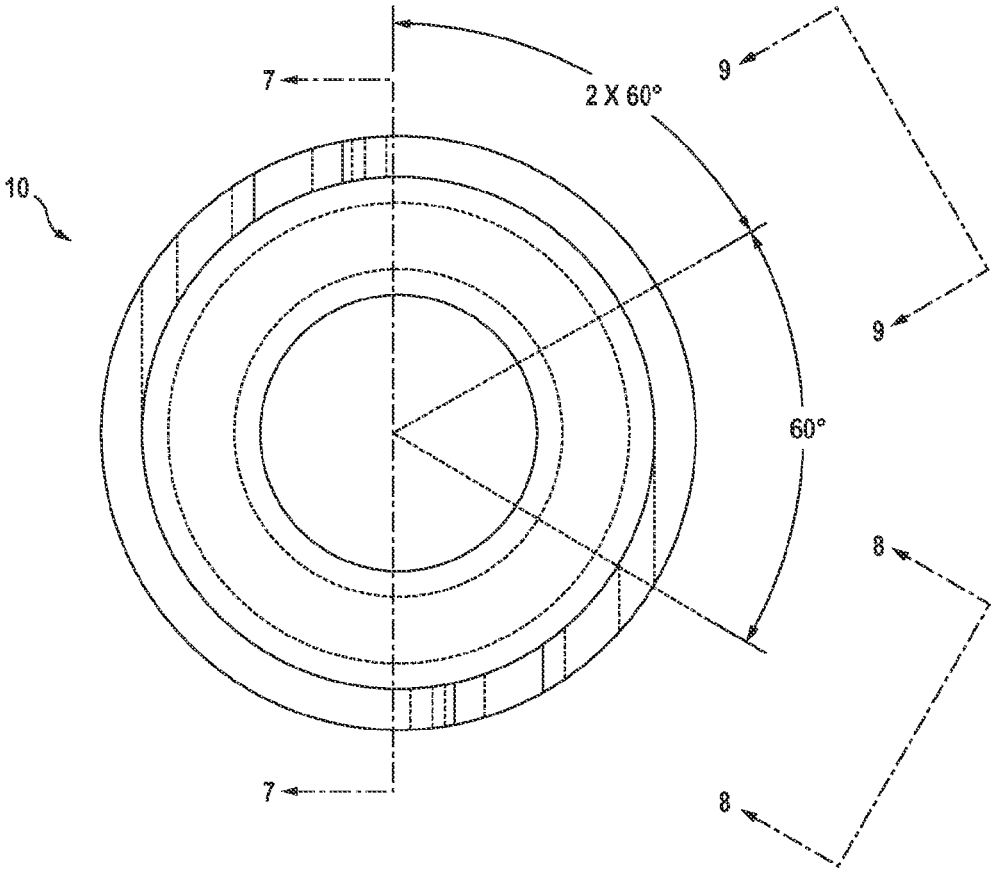
FIG. 6 is a top plan view of an implantable receptacle for a hearing aid component in accordance with the first embodiment.
Figure 7:
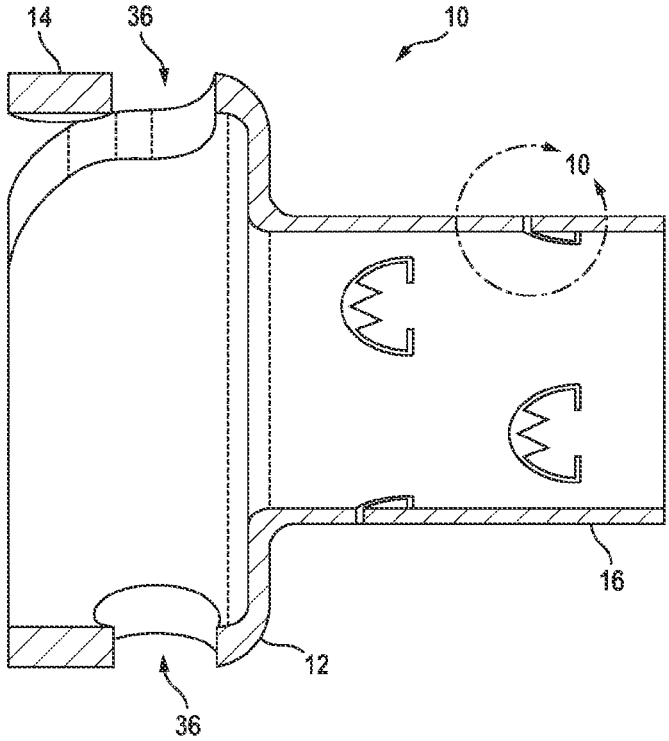
FIG. 7 is a cross-sectional drawing taken along line 7-7 of FIG. 6.
Figure 8:
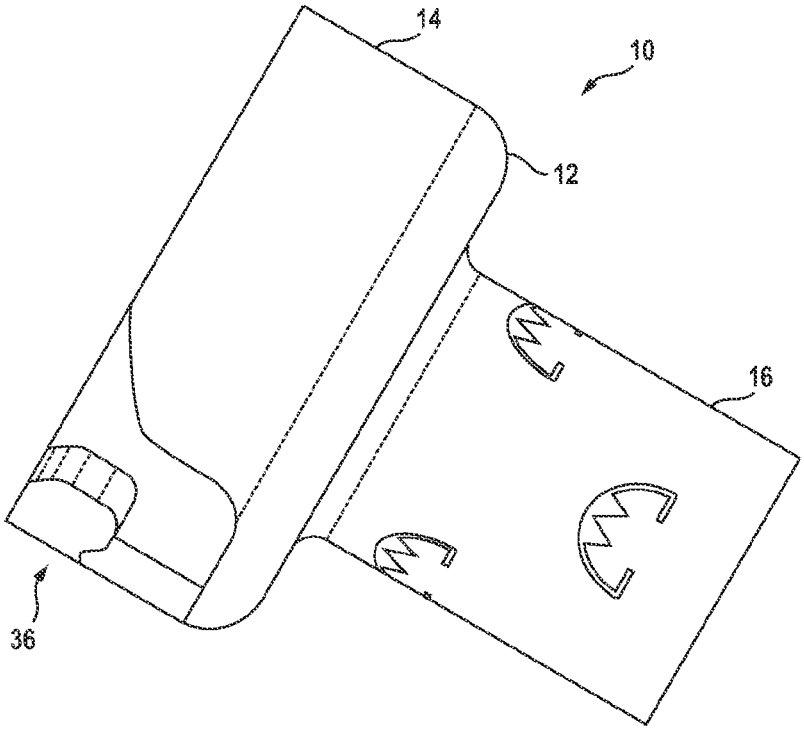
FIG. 8 is a side view drawing taken from line 8-8 of FIG. 6.
Figure 9:
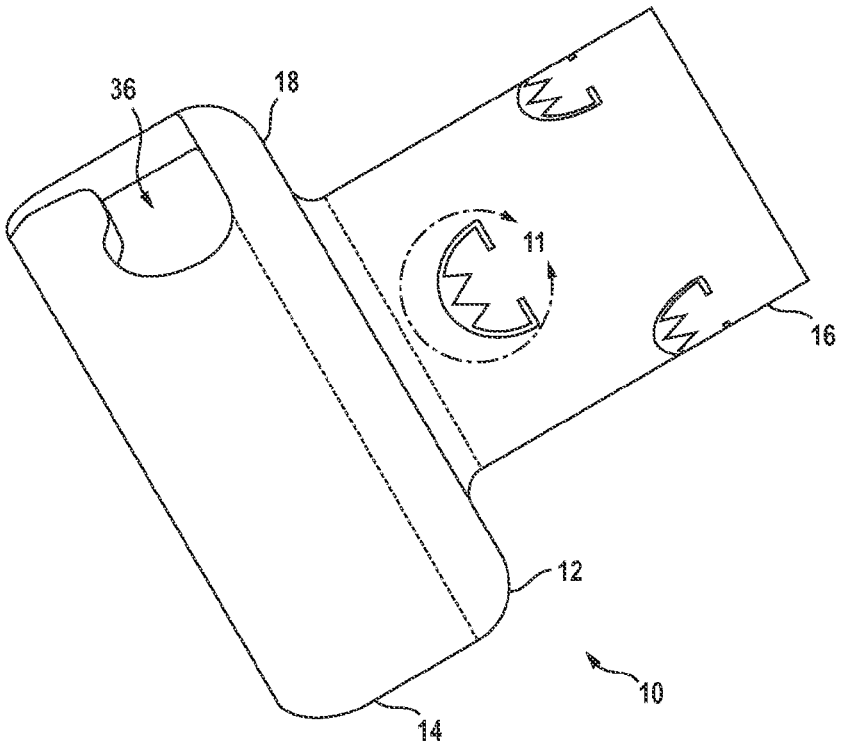
FIG. 9 is a side-view drawing taken from line 9-9 of FIG. 6.
Figure 10:
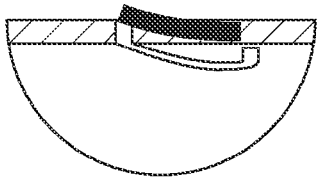
FIG. 10 is a detailed view of area 10 of FIG. 7.
Figure 11:
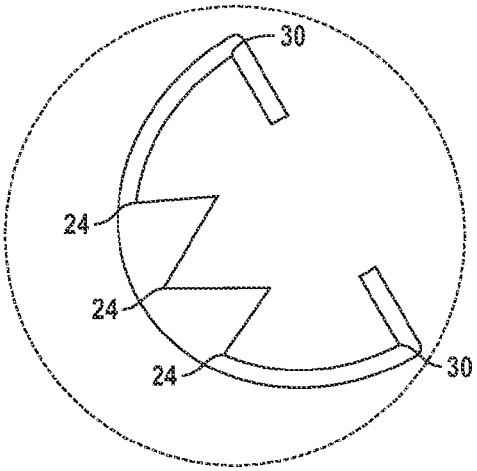
FIG. 11 is a detailed view of area 11 of FIG. 9.

Additional detail is provided in FIGS. 6-11. FIG. 6 is a top plan view of an implantable receptacle for a hearing aid component in accordance with the first embodiment; FIG. 7 is a cross-sectional drawing taken along line 7-7 of FIG. 6; FIG. 8 is a cross-sectional drawing taken along line 8-8 of FIG. 6; FIG. 9 is a cross-sectional drawing taken along line 9-9 of FIG. 6; FIG. 10 is a detailed view of area 10 of FIG. 7; and FIG. 11 is a detailed view of area 11 of FIG. 9.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. An implantable receptacle for receiving a hearing aid component, the receptacle comprising:

a body having a proximal portion, a distal cylindrical portion and a joining portion joining the proximal portion to the distal cylindrical portion;

the proximal portion having a first cross-sectional maximum axial diameter and the distal portion having a second, smaller, maximum cross-sectional axial diameter;

a first plurality of flexible first tines formed in the wall of the distal cylindrical portion, each of the first tines extending from an outer wall of the distal cylindrical portion in a direction of the proximal portion and configured to engage with and lock the distal cylindrical portion to a wall of a fenestration in a bone of the patient in response to pressing a sleeve into the fenestration; and a second plurality of flexible second tines formed in the wall of the distal cylindrical portion, each of the second tines extending from the outer surface of the wall of the distal cylindrical portion in a direction tangential to the circumference of the distal cylindrical portion such that each of the second tines are perpendicular to the direction of the proximal portion and configured to engage with and prevent rotation of the distal cylindrical portion within the wall of the fenestration.

2. The receptacle of claim 1, wherein the proximal portion is cylindrical and includes at least one bayonet-type locking sleeve configured to engage with at least one corresponding pin extending from the hearing aid component and removably lock the hearing aid component to the receptacle.

3. The receptacle of claim 2, wherein the receptacle comprises titanium.

4. The receptacle of claim 2, wherein the receptacle is formed entirely from titanium.

5. The receptacle of claim 1, wherein the receptacle comprises titanium.

6. The receptacle of claim 1, wherein the receptacle is formed entirely from titanium.

* * * * *